US009670724B2

(12) United States Patent
Oakley

(10) Patent No.: US 9,670,724 B2
(45) Date of Patent: Jun. 6, 2017

(54) SYSTEM AND METHOD FOR MANUAL AND MOTORIZED MANIPULATION OF AN ARCHITECTURAL COVERING

(71) Applicant: QMOTION INCORPORATED, Pensacola, FL (US)

(72) Inventor: Lucas Hunter Oakley, Pensacola, FL (US)

(73) Assignee: The Watt Stopper, Inc., Santa Clara, CA (US)

( * ) Notice: Subject to any disclaimer, the term of this patent is extended or adjusted under 35 U.S.C. 154(b) by 0 days.

(21) Appl. No.: 14/783,376

(22) PCT Filed: Apr. 16, 2014

(86) PCT No.: PCT/US2014/034419
§ 371 (c)(1),
(2) Date: Oct. 8, 2015

(87) PCT Pub. No.: WO2014/172493
PCT Pub. Date: Oct. 23, 2014

(65) Prior Publication Data

US 2016/0201389 A1 Jul. 14, 2016

Related U.S. Application Data

(60) Provisional application No. 61/812,814, filed on Apr. 17, 2013.

(51) Int. Cl.
*A47H 5/00* (2006.01)
*E06B 9/60* (2006.01)
(Continued)

(52) U.S. Cl.
CPC ..... *E06B 9/60* (2013.01); *E06B 9/322* (2013.01); *E06B 9/70* (2013.01); *E06B 9/74* (2013.01);
(Continued)

(58) Field of Classification Search
CPC ..... E06B 9/60; E06B 9/68; E06B 2009/2627; E06B 9/322; E06B 2009/3222
(Continued)

(56) References Cited

U.S. PATENT DOCUMENTS 5,909,093 A * 6/1999 van Dinteren ..... E06B 9/32 318/16
5,927,370 A * 7/1999 Judkins ..... E06B 9/262 160/291
(Continued)

*Primary Examiner* — Katherine Mitchell
*Assistant Examiner* — Johnnie A Shablack
(74) *Attorney, Agent, or Firm* — Christopher A. Proskey; BrownWinick Law Firm

(57) ABSTRACT

An architectural covering is presented that can be manually moved as well as moved through motorized manipulation. The system includes a header, a bottom bar and shade material and suspension cords extending therebetween. The header has an open interior compartment which includes a spring housing, a drive shaft assembly, spool assemblies and a motor assembly. The architectural covering can be manually moved by pulling on the shade material. The shade can also me moved via motorization by actuating the motor assembly through tugging, a remote control device, a voice actuation device or through the internet. In this way a novel architectural covering is presented that is easier to use than the prior art and has a plurality of methods of operation.

17 Claims, 9 Drawing Sheets

(51) Int. Cl.
*E06B 9/70* (2006.01)
*E06B 9/322* (2006.01)
*E06B 9/74* (2006.01)
*E06B 9/262* (2006.01)

(52) U.S. Cl.
CPC ..... *E06B 2009/2627* (2013.01); *E06B 2009/3222* (2013.01)

(58) Field of Classification Search
USPC .... 160/84.01, 84.02, 84.04, 84.05, 191, 192
See application file for complete search history.

(56) References Cited

U.S. PATENT DOCUMENTS 6,012,506 A * 1/2000 Wang ..... E06B 9/30 160/170
6,049,293 A * 4/2000 Koot ..... H04W 52/0229 340/12.16
6,056,036 A * 5/2000 Todd ..... E06B 9/262 160/84.01
6,234,236 B1 * 5/2001 Kuhar ..... E06B 9/32 160/170
6,259,218 B1 * 7/2001 Kovach ..... E06B 9/262 318/16
6,536,503 B1 * 3/2003 Anderson ..... E06B 9/262 160/170
6,680,594 B2 * 1/2004 Collett ..... E06B 9/32 160/310
6,968,884 B2 * 11/2005 Anderson ..... E06B 9/262 160/170
7,143,802 B2 * 12/2006 Strand ..... E06B 9/262 160/167 R
7,185,691 B2 * 3/2007 Toti ..... E06B 9/262 160/170
7,866,367 B2 * 1/2011 Liang ..... E06B 9/307 160/170
7,975,748 B2 * 7/2011 Yu ..... E06B 9/322 160/170
8,230,896 B2 * 7/2012 Anderson ..... E06B 9/262 160/170
8,299,734 B2 * 10/2012 Mullet ..... E06B 9/42 160/133
8,368,328 B2 * 2/2013 Mullet ..... E06B 9/42 160/133
8,432,117 B2 * 4/2013 Berman ..... E06B 9/322 318/280
8,522,852 B2 * 9/2013 Yu ..... E06B 9/322 160/170
8,573,281 B2 * 11/2013 Drew ..... E06B 9/262 160/173 R
8,659,246 B2 * 2/2014 Mullet ..... E06B 9/40 160/133
8,791,658 B2 * 7/2014 Mullet ..... E06B 9/40 160/133
8,820,388 B2 * 9/2014 Mullet ..... E06B 9/322 160/310
8,939,190 B2 * 1/2015 Mullet ..... E06B 9/307 160/176.1 P
8,950,461 B2 * 2/2015 Adams ..... E06B 9/32 160/1
9,091,115 B2 * 7/2015 Mullet ..... E06B 9/307
9,103,157 B2 * 8/2015 Mullet ..... E06B 9/322
9,217,282 B2 * 12/2015 Defenbaugh ..... E06B 9/68
2004/0154758 A1 * 8/2004 Cheng ..... E06B 9/262 160/170
2006/0076113 A1 * 4/2006 Park ..... E06B 9/264 160/107
2007/0051477 A1 * 3/2007 Fraser ..... E06B 9/262 160/84.05
2008/0236763 A1 * 10/2008 Kates ..... E06B 9/32 160/5
2011/0000628 A1 * 1/2011 Anderson ..... E06B 9/262 160/313
2011/0277943 A1 * 11/2011 Lin ..... E06B 9/262 160/84.04
2012/0095601 A1 * 4/2012 Abraham ..... E06B 9/68 700/278
2012/0111509 A1 * 5/2012 Mullet ..... E06B 9/307 160/331
2012/0261078 A1 * 10/2012 Adams ..... E06B 9/32 160/6
2013/0248125 A1 * 9/2013 Lin ..... E06B 9/262 160/84.05
2013/0255890 A1 * 10/2013 Mullet ..... E06B 9/307 160/168.1 P
2014/0014279 A1 * 1/2014 Defenbaugh ..... E06B 9/68 160/168.1 P
2014/0157547 A1 * 6/2014 Chen ..... E06B 9/42 16/400
2014/0262062 A1 * 9/2014 Higgins ..... E06B 9/42 160/84.01
2014/0305601 A1 * 10/2014 Mullet ..... E06B 9/322 160/170
2015/0013920 A1 * 1/2015 Mullet ..... E06B 9/303 160/7
2015/0028144 A1 * 1/2015 Defenbaugh ..... E06B 9/322 242/378.4
2015/0308186 A1 * 10/2015 Mullet ..... E06B 9/322 160/313
2016/0032647 A1 * 2/2016 Adreon ..... E06B 9/322 310/68 B
2016/0201389 A1 * 7/2016 Oakley ..... E06B 9/322 160/368.1
2016/0222722 A1 * 8/2016 Schulman ..... E06B 9/322
2016/0222723 A1 * 8/2016 Morris ..... E06B 9/262
2016/0230455 A1 * 8/2016 Dekker ..... E06B 9/322

* cited by examiner

SYSTEM AND METHOD FOR MANUAL AND MOTORIZED MANIPULATION OF AN ARCHITECTURAL COVERING

FIELD OF THE INVENTION

This invention relates to an architectural covering. More specifically, and without limitation, this invention relates to a system and method for manual and motorized manipulation of an architectural covering.

BACKGROUND OF INVENTION

Springs:

Springs are old and well known in the art. Generally speaking, a spring is an elastic object used to store mechanical energy. When compressed or stretched, depending on its design, a spring exerts a force proportional to its change in length (Hooke's law). This property is useful in countless applications and as such springs have been adopted for use in endless array of mechanical devices.

Various spring designs have been developed which are particularly well suited for specific applications. Some of these designs, which are of importance to this invention, are as follows.

Ribbon Springs:

The term ribbon spring is used to describe any number of spring designs having a rolled ribbon of flat or curved spring steel which produce a force when actuated out of their static curvature. Types of ribbon springs include the following:

Constant Force Springs (Conforce Springs):

A constant-force spring is a spring for which the force it exerts over its range of motion or length is a constant, or generally constant. That is, constant force springs do not obey Hooke's law. Generally speaking constant-force springs are constructed as a rolled ribbon of spring steel such that the spring is relaxed when it is fully rolled up, either around itself or around a spool. As it is unrolled, the restoring force comes primarily from the portion of the ribbon near the roll. Because the geometry of that region remains nearly constant as the spring unrolls, the resulting force is nearly constant.

More specifically, constant force spring includes a pre-stressed flat strip of spring material which is formed into virtually constant radius coils around itself or a spool. When the strip is extended (deflected) the inherent stress in the strip resists the loading force, the same as a common extension spring, but at a nearly constant (zero) rate. A constant torque is obtained when the outer end of the spring is attached to another spool and caused to wind in either the reverse or same direction as it is originally wound.

The full rated load of the spring is reached after being deflected to a length equal to 1.25 times its diameter. Thereafter, it maintains a relatively constant force regardless of extension length. Load is basically determined by the thickness and width of the material and the diameter of the coil.

Fatigue life ranges from 2,500 cycles to over a million cycles depending upon the load and size of the spring. Working deflections of 50 times the spool diameter can be achieved.

Constant force springs have been adopted for use in counterbalances, door closers, cable retractors, hose retrievers, tool head returns, cabinet & furniture components, gym equipment, hair dryers, toys, electric motors, appliances, space vehicles, and other long-motion functions. Constant force springs are particularly well suited in applications where a constant load is applied.

Variable Force Springs:

Variable force springs are similar to constant force springs in that they are constructed of a rolled ribbon of spring steel such that the spring is relaxed when it is fully rolled up. Variable force springs differ from constant force springs in that the force they produce intentionally varies along the length of the ribbon of spring steel. This varying force is accomplished by forming the pre-stressed flat strip of spring material into non-constant radius coils that wrap around itself or a spool. That is, the radius of the coils of the strip of spring material varies along the length of the strip of spring material. When the strip is extended (deflected) the inherent stress in the strip resists the loading force, the same as a common extension spring, but at a varying rate depending on the position of the deflection in the strip of spring material.

In some applications, it is desirable for the spring to have less force as it is extended, while in others it is preferable to have more force; in yet other applications it is desirable for the spring to have variable force along its length, that is as the spring is extended the force increases, then begins to decrease, then begins to increase again, then begins to decrease again and so on. A spring that produces less force while being extended is said to have a negative gradient. Negative gradients of as much as 25% or more are possible. A spring that produces more force as it is extended has a positive gradient. Positive gradients of 500% or more are possible.

Constant Torque Springs (Contorque Springs):

Constant-torque springs are similar to constant force springs and variable force springs in that they are constructed of a rolled ribbon of spring steel such that the spring is relaxed when it is fully rolled up. Constant torque springs differ from constant force springs and variable force springs in that a constant torque spring is made up of a specially stressed constant force spring traveling between two spools, a storage spool and an output spool. The spring is stored on the storage spool and wound reverse to its natural curvature on an output spool. When released, torque is obtained from the output spool as the spring returns to its natural curvature on the storage spool. No useful torque may be obtained from the storage spool. The torque produced by a constant torque spring can be constant over the entire retraction of the spring—known as constant force constant torque springs. The springs may also be designed to produce a negative gradient, or a positive gradient, in the manner described with respect to variable force springs—known as variable force constant torque springs. These unique features make this spring-form desirable for many applications, including counterbalances, clock motors, self-energizing position indicators, cord or cable retractors, and mechanical drives.

Architectural Coverings:

Architectural coverings are also old and well known in the art. The term architectural covering(s) is used herein to describe any architectural covering such as a blind, shade, drapery or the like, and the term is not meant to be limiting.

One common problem with many architectural coverings is that they have a torque profile that is not constant. That is, in a conventional architectural covering, which extends between an open position, wherein the shade material and bottom bar are adjacent one another near the top of a window in a fully collapsed position, and a closed position wherein the header and bottom bar are spaced as far away from one another as the shade material will allow in a fully extended position, the most amount of force is on the suspension cords in the open position whereas the least amount of force is on the suspension cords in the closed position. This is because the entire weight of the bottom bar and shade material is supported by the suspension cords in the open position, as well as some force for compressing the shade material. As the architectural covering is opened, because the shade material is connected to the header, more and more weight is transferred to the header (by the fact that the shade material is hanging from the header) and less and less weight is supported by the suspension cords. This varying weight profile provides a complex problem when trying to counterbalance and motorize an architectural covering.

Thus, it is a primary object of the invention to provide a system and method of manual and motorized manipulation of an architectural covering that improves upon the state of the art.

Another object of the invention is to provide a system and method of manual and motorized manipulation of an architectural covering that is easy to use.

Yet another object of the invention is to provide a system and method of manual and motorized manipulation of an architectural covering that is efficient.

Another object of the invention is to provide a system and method of manual and motorized manipulation of an architectural covering that is simple.

Yet another object of the invention is to provide a system and method of manual and motorized manipulation of an architectural covering that is inexpensive.

Another object of the invention is to provide a system and method of manual and motorized manipulation of an architectural covering that has a minimum number of parts.

Yet another object of the invention is to provide a system and method of manual and motorized manipulation of an architectural covering that has an intuitive design.

Another object of the invention is to provide a system and method of manual and motorized manipulation of an architectural covering wherein the counterbalance torque profile closely matches and varies along the length between an open position and a closed position of the architectural covering.

Yet another object of the invention is to provide a system and method of manual and motorized manipulation of an architectural covering that requires a minimal amount of power to open and close the architectural covering.

Another object of the invention is to provide a system and method of manual and motorized manipulation of an architectural covering that provides long battery life because a minimal amount of power is required to open and close the architectural covering.

Yet another object of the invention is to provide a system and method of manual and motorized manipulation of an architectural covering that allows for manual as well as motorized movement of the architectural covering.

These and other objects, features, or advantages of the present invention will become apparent from the specification and claims.

SUMMARY OF THE INVENTION

An architectural covering is presented that can be manually moved as well as moved through motorized manipulation. The system includes a header, a bottom bar and shade material and suspension cords extending therebetween. The header has an open interior compartment which includes a spring housing, a drive shaft assembly, spool assemblies and a motor assembly. The architectural covering can be manually moved by pulling on the shade material. The shade can also me moved via motorization by actuating the motor assembly through tugging, a remote control device, a voice actuation device or through the internet. In this way a novel architectural covering is presented that is easier to use than the prior art and has a plurality of methods of operation.

DETAILED DESCRIPTION OF THE INVENTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the present inventions. The following detailed description is, therefore, not to be taken in a limiting sense, and the scope of the present invention is defined only by the appended claims, along with the full scope of equivalents to which such claims are entitled.

As used herein, the terminology such as vertical, horizontal, top, bottom, front, back, end and sides are referenced according to the views presented. It should be understood, however, that the terms are used only for purposes of description, and are not intended to be used as limitations. Accordingly, orientation of an object or a combination of objects may change without departing from the scope of the invention.

As used herein, the invention is shown and described as being used in association with an architectural covering however the invention is not so limiting. Instead, one of ordinary skill in the art will appreciate that the system and method presented herein can be applied to any mechanical device, without limitation. The system and method is merely shown and described as being used in association with an architectural covering for ease of description and as one of countless examples.

As used herein, the term architectural covering refers to any covering such as a blind, drape, roller shade, venetian blind, or the like, especially used in association with windows. This term is in no way meant to be limiting. Instead, one of ordinary skill in the art will appreciate that the system and method presented herein can be applied to any architectural covering, without limitation.

Figure 1:
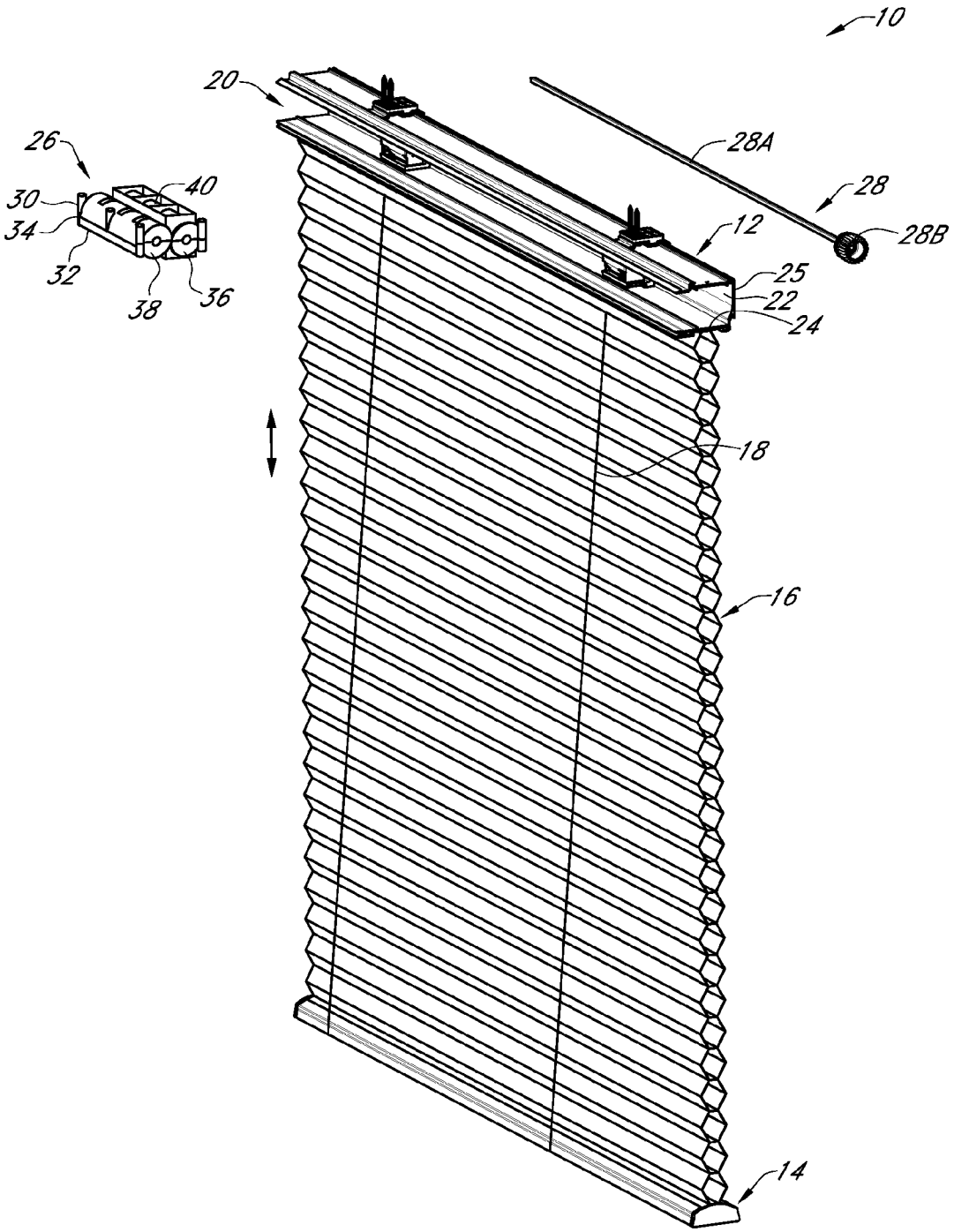
FIG. 1 is a perspective exploded view of an architectural covering having a spring housing and a drive shaft assembly in its header.

With reference to FIG. 1, an architectural covering 10 is presented. Architectural covering 10 is formed of any suitable size and shape. In one arrangement, as is shown, architectural covering 10 includes a header 12 and a bottom bar 14. Shade material 16 extends between header 12 and bottom bar 14. Shade material 16 connects at its upper end adjacent the bottom of header 12, and connects at its lower end adjacent the top of bottom bar 14.

At least one, suspension cord 18 is connected to or passes through shade material 18. In the arrangement shown, a pair of suspension cords 18 are shown, one adjacent each side of architectural covering 10 to provide lateral balance. Suspension cord 18 connects at its lower end to bottom bar 14, and connects at its upper end to header 12. Through extension and retraction of suspension cord 18, bottom bar 14 extends in the vertical plane between a fully open position, wherein bottom bar 14 is adjacent header 12 and shade material 16 is fully collapsed, and a fully closed position, wherein bottom bar 14 is spaced away from header 12 as far as suspension cord 18 and shade material 16 will allow.

Header 12 is formed of any suitable size and shape. In one arrangement, as is shown, header 12 has an open interior compartment 20. Interior compartment 20 has a generally flat ceiling 22 positioned in approximate parallel spaced alignment to a generally flat and straight floor 24. Ceiling 22 and floor 24 are connected by generally flat and straight back wall 25 which connects to the rearward edges of ceiling 22 and floor 24 in approximate perpendicular alignment thereto. A spring housing 26 is positioned within compartment 20 of header 12. A drive shaft assembly 28 is also positioned within compartment 20 of header 12. Spring housing 26 and drive shaft assembly 28 are formed of any suitable size, shape and design. In one arrangement, as is shown, drive shaft assembly 28 extends through a portion of spring housing 26, and/or through the entire spring housing 26 and extends outwardly therefrom on both sides of spring housing 26. In the arrangement shown, drive shaft assembly 28 has a drive shaft 28A which in the arrangement shown is an elongated square bar or tube that extends a length within open interior 20, however it can be formed of any size, shape and design. In the arrangement shown, drive shaft assembly 28 has a drive gear 28B connected to an end of drive shaft 28A, in the arrangement shown, drive gear 28B is a male drive gear, however any design, shape or style is hereby contemplated.

Spring housing 26 is formed of any suitable size, shape and design. In one arrangement, as is shown, spring housing 26 has a clamshell design having a top half 30 and a bottom half 32, which connect to one another along a seam line 34 positioned there between. The top half 30 and bottom half 32 are generally mirror images of one another, or symmetric to one another along the seam line 34 between top half 30 and bottom half 32.

The exterior surface of spring housing 26 takes on any form or shape to accommodate the components of spring housing 26. As is seen in the figures, as an example, the spring housing 26 has an output side 36 and storage side 38 which are generally formed in an approximate cylindrical shape when viewed from the side. The generally cylindrical shaped output side 36 and storage side 38 are connected to one another adjacent their inward side or edge. The exterior surface of output side 36 also has support members 40 which extend outwardly therefrom and terminate in a generally flat and straight support surface 42, which is designed to flushly and matingly engage the floor 24 or ceiling 22 of open interior 20 of header 12. This arrangement of close tolerances between interior compartment 20 and spring housing 26 locks spring housing 26 within interior compartment 20 and prevents unintended rattling or movement.

Spring housing 26 also has a plurality of connection sockets 44. Connection sockets 44 are formed of any suitable size and shape and are used to connect the top half 30 of spring housing 26 to the bottom half 32 of spring housing 26. In one arrangement, as is shown, connection sockets 44 are threaded openings which allow a fastener 46, such as a conventional screw or bolt, to pass there through and threadably tighten the top half 30 to the bottom half 32. However any other arrangement of connecting two objects together is hereby contemplated such as buttons, a snap fit feature, gluing, welding or the like. In the arrangement shown, a connection socket 44 is positioned in each corner of the spring housing 26 and one on each side adjacent the center of spring housing 26.

A drive hole 48 is positioned adjacent the center of the output side 36 of spring housing 26 and extends laterally. Drive hole 48 is formed of any suitable size and shape. In one arrangement, as is shown, drive hole 48 is a square hole that extends through the center of output side 36 and through the entire lateral length of spring housing 26 from side to side.

A locking hole 50 is also positioned in the output side 36 of spring housing 26. Locking hole 50 is formed of any suitable size and shape. In one arrangement, as is shown, locking hole 50 is a round hole that extends through the entire lateral length of spring housing 26 from side to side. Locking hole 50 is positioned off-center from the center of output side 36. In the arrangement shown, locking hole 50 is positioned on the seam line 34 between the top half 30 and bottom half 34 of spring housing 26. Also, in the arrangement shown, locking hole 50 is positioned between drive hole 50 and storage side 38.

Spring housing 26 has an open interior compartment 52. Open interior compartment 52 is formed of any suitable size and shape. As an example, in the arrangement shown, along the output side 36 of the open interior 52, a plurality of output spool recesses 54 are positioned in line with one another. Each output spool recess 54 is formed of any suitable size and shape. In one arrangement, as is shown, each output spool recess 54 is centered upon drive hole 48 and drive axis of rotation 55 and terminates on its lateral sides at end wall 56. That is, an end wall 56 is positioned on each lateral side of each output spool recess 54, with adjacent output spool recesses 54 sharing an end wall 56 therebetween. Each end 56 wall has a collar portion 58 centered around drive hole 48. In one arrangement, as is shown, collar portion 58 is a generally cylindrical recess, such that when the top half 30 and bottom half 32 are connected to one another, the collar portions 58 of opposing end walls 56 align to form a generally circular opening.

Output spool recesses 54 are sized and shaped to matingly receive an output spool 60 within close tolerance while allowing output spool 60 to freely rotate therein. Output spool 60 has a generally cylindrical axel portion 62 which is positioned adjacent the center of output spool 60 and positioned around drive hole 48. Axel portion 62 is generally cylindrical in shape. A flange 64 is positioned at both ends of axel portion 62 that serves to terminate axel portion 62. Flanges 64 are round and generally flat, such as in the form of a conventional washer, and extend in parallel spaced relation to one another and in perpendicular relation the length and/or axis of axel portion 62.

Axel portion 62 has a slot opening 66 therein with a locking feature 68 positioned within the slot opening 66. Slot opening 66 is designed to receive a tail portion 70 of a ribbon spring 72 having a punch opening 74 therein. Locking feature 68 is formed of any suitable size and shape which is suitable for locking two components together. In one arrangement, as is shown, locking feature 68 is a post or hook that extends into slot opening 66 and is designed to receive and hold on to or lock on to punch opening 74 of tail portion 70 of ribbon spring 72. A neck portion 75 extends outwardly from flanges 64 on the side opposite axel portion 62. Neck portion 75 is generally circular in shape and is generally centered with respect to axel portion 62, flanges 64 and drive axis of rotation 55. Neck portion 75 is matingly received within collar portion 58 of the top half 30 and bottom half 32 of spring housing 26. In this way, neck portion 75 supports and suspends output spool 60 within output spool recess 54 and allows for output spool 60 to rotate therein with only frictional engagement and contact between neck portion 75 of output spool 60 and collar portion 58 of top half 30 and bottom half 32 of spring housing 26. To reduce friction and improve rotation there between, a bearing, bushing or any other rotation improving and wear resisting member is positioned therein. In one arrangement, collar portion 58 forms the drive hole 48.

Output spools 60 have a drive hole 65A (that corresponds with drive hole 48 of spring housing 26) and a locking hole 65B (that corresponds with locking hole 50 of spring housing 26) which pass through the entire output spool 60. In the arrangement shown, drive hole 65A is positioned in alignment with drive hole 48 of spring housing 26 and is centered on drive axis of rotation 55 such that output spool 60 rotates upon drive hole 65A when drive spool 60 is positioned within output spool recess 54. In this arrangement, drive hole 65A passes through the center of axel portion 62, flanges 64 and neck portion 75 and in alignment there with. Locking hole 65B similarly passes through flanges 64 however locking hole 65B is offset or off center to the drive axis of rotation 55. Locking hole 65B is positioned in alignment with locking hole 50 of spring housing 26. While locking hole 65B is offset in relation to the drive axis of rotation 55, locking hole 65B also passes through a hole, slot, groove, recess or opening in axel portion 62, such that when a pin is inserted through locking hole 65B it does not interrupt or engage any ribbon spring 72 that may be wrapped around axel portion 62. One or multiple locking holes 65B may be presented around the output spool 60. Additional locking holes 65B, such as two, three, four, five, six or more, positioned around the output spool 60 provide the ability to more precisely tune spring housing 26 as is described herein.

Along the storage side 38 of the open interior 52, a plurality of storage spool recesses 76 are positioned in line with one another. Storage spool recesses 76 are formed of any suitable size and shape. As an example, in the arrangement shown, each storage spool recess 76 is positioned adjacent to and in alignment with a corresponding output spool recess 54. Each storage spool recess 76 is formed of any suitable size and shape. In one arrangement, as is shown, each storage spool recess 76 is centered upon storage axis of rotation 78 and terminates on its lateral sides at end wall 56. Storage axis of rotation 78 and drive axis of rotation 55 are positioned in parallel spaced alignment and are positioned in line or centered with the plane of seam line 34. End wall 56 is positioned on each lateral side of each storage spool recess 78, with adjacent storage spool recesses 78 sharing an end wall 56 therebetween. Each end 56 wall has a collar portion 58 centered around storage axis of rotation 78. In one arrangement, as is shown, collar portion 58 is a generally cylindrical recess, such that when the top half 30 and bottom half 32 are connected to one another, the collar portions 58 of opposing end walls 56 align to form a generally circular opening. In this way, storage spool recesses 76 are quite similar, but not identical to, output spool recesses 54.

Storage spool recesses 76 are sized and shaped to matingly receive a storage spool 80 within close tolerance while allowing storage spool 80 to freely rotate therein. Storage spool 80 has a generally cylindrical axel portion 82 which is positioned adjacent the center of storage spool 80. A flange 84 is positioned at both ends of axel portion 82 that serves to terminate axel portion 82. Flanges 84 are round and generally flat, such as in the form of a conventional washer, and extend in parallel spaced relation to one another and in perpendicular relation the length and/or axis of axel portion 82. A neck portion 86 extends outwardly from flanges 84 on the side opposite axel portion 82. Neck portion 86 is generally circular in shape and is generally centered with respect to axel portion 82, flanges 64 and storage axis of rotation 78. Neck portion 86 is matingly received within collar portion 58 of the top half 30 and bottom half 32 of spring housing 26. In this way, neck portion 86 supports and suspends storage spool 80 within storage spool recess 76 and allows for storage spool 80 to rotate therein with only frictional engagement and contact between neck portion 86 of storage spool 80 and collar portion 58 of top half 30 and bottom half 32 of spring housing 26. To reduce friction and improve rotation there between, a bearing, bushing or any other rotation improving and wear resisting member is positioned therein. Ribbon spring 72 is positioned around axel portion 82 between flanges 84 which is supported by storage spool 80.

In an alternative arrangement, storage spools 80 do not rotate within storage spool recesses 76. In this arrangement, instead of neck portion 86 of storage spool 80 being round, neck portion 86 is any other shape that prevents rotation, such as square. Alternatively, neck portion 86 is screwed, bolted, snapped or held into place in any other manner to prevent rotation. In this arrangement, collar portion 58 of end wall 56 of storage spool recesses 76 are a mating shape, such as in this example, square as well. In this arrangement, the ribbon spring rotates upon axel portion 82, instead of the entire storage spool 80 rotating.

In one arrangement, the spring housing 26 can be preloaded with a plurality of ribbon springs 72 that can be of any type described herein such as constant force springs, constant torque springs, variable force springs, positive gradient springs, negative gradient springs, or the like. These ribbon springs 72 can be pre-wound or preloaded and can be positioned in standard or reverse wind positions as described in Applicant's related Patent Application entitled System And Method For Pre-Winding And Locking Constant Torque Springs In A Spring Housing; Ser. No. 61/807,826 filed on Apr. 3, 2013, which is fully incorporated by reference herein.

Spring Housing Assembly, Operation, and Use:

Shade material 16 is connected at its upper end to header 12 and at its bottom end to bottom bar 14. Suspension cords are connected to bottom bar 14, passed through shade material 16 and into the open interior compartment 20 of header 12. The forces placed on header 12 as the architectural covering 10 is opened and closed are dynamic. Meaning that the forces change or vary between a fully open position, with the bottom bar 14 adjacent the header 12, and a fully closed position, with the bottom bar 14 spaced all the way away from header 12. The architectural covering 10 is manipulated between a fully open position and a fully closed position by extending or retracting suspension cords 18.

In a fully open position, practically the entire weight of the bottom bar 14 and shade material 16 must be supported by suspension cords 18. In addition, there may be additional forces in a fully open position because the shade material 16 is being compressed and therefore the shade material 16 presses outward. In a fully open position, the most amount of weight or force is placed upon suspension cords 18.

In contrast, in a fully closed position, the least amount of weight or force is applied to suspension cords 18. This is because shade material 16 is directly connected at its upper end 16 to header 12 and in a fully open position, shade material 16 is fully extended. As such, much of the weight of the shade material 16, as well as the bottom bar 14, is transferred to the header 12, and not the suspension cords 18.

This weight dynamically changes between a fully open and a fully closed position, as more and more weight is transferred from the suspension cords 18 to the header 12. This changing weight profile is termed the torque profile of the architectural covering as described in Applicant's related patent application entitled Spring Counterbalance Apparatus and Method; Ser. No. 13/573,526 filed on Saturday, Apr. 13, 2013, which is fully incorporated by reference herein. This varying torque profile provides significant challenges to both manual and motorized operation of architectural coverings. These problems are substantially complicated even further when attempting to provide an architectural covering that can be operated by both motorization as well as manual operation.

Accordingly, to ensure a constant weight or torque, or close to constant weight or torque, is required to operate the architectural covering throughout the opening and closing cycle, a dynamic counterbalance system is necessary to balance or match the changing weight on the suspension cords.

This dynamic counterbalance is created through a combination of ribbon springs 72 positioned within spring housing 26. These ribbon springs 72 can be any combination or form of constant torque springs, constant force springs, variable force springs, with either positive gradients, negative gradients or variable gradients, or the like. The strength, weigh, thickness, width, curvature (such as constant curvature in a constant force spring, or varying curvature in a variable force spring) or any other features of each of these ribbon springs 72 can be varied to accomplish an endless array of different counterbalance weights at any position along the open/close cycle. As such, using the spring housing 26 described herein, a torque profile can be provided that closely matches the torque profile of the architectural covering 10.

Figure 3:
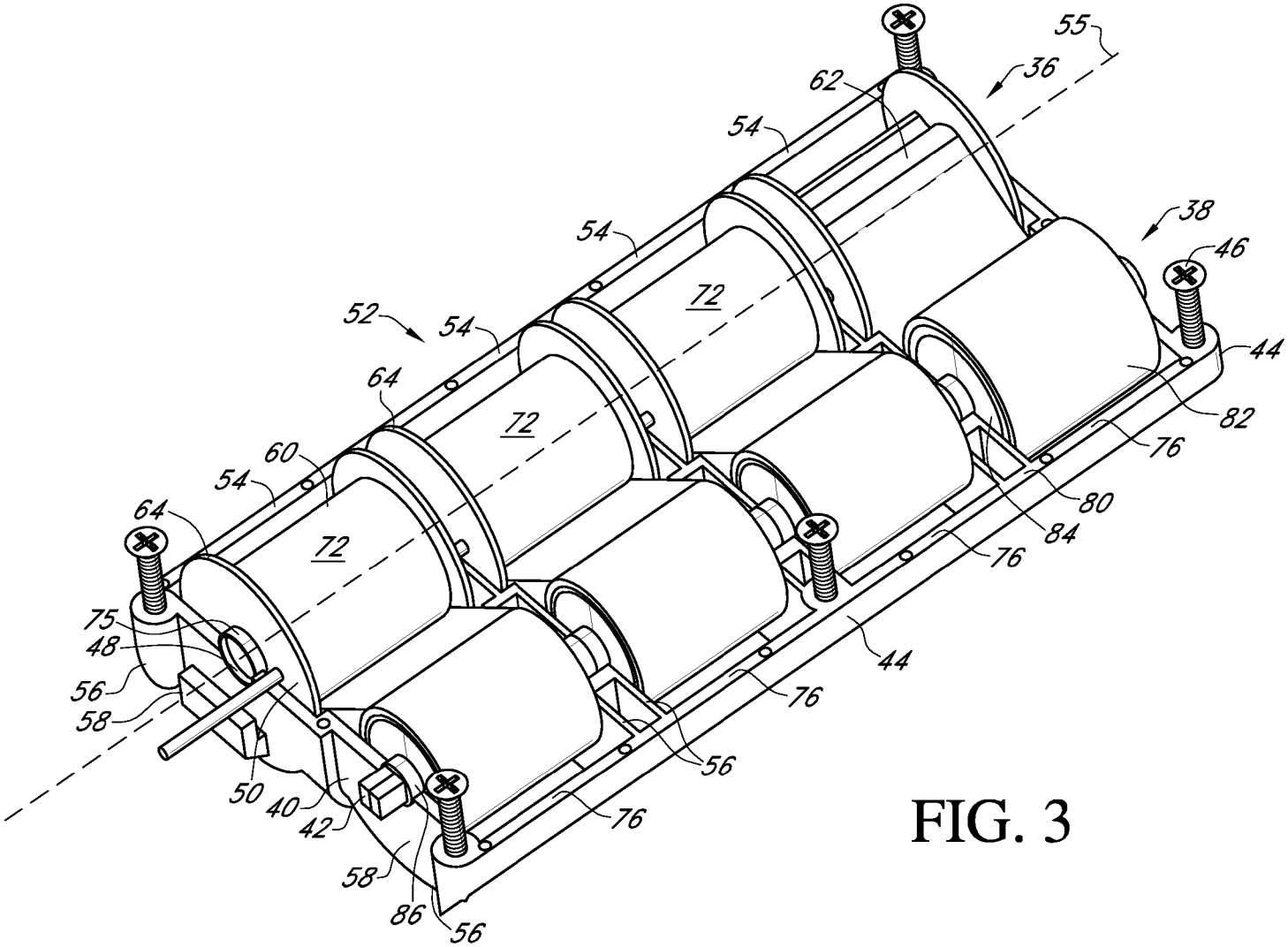
FIG. 3 is a perspective cut-away view of a spring housing and a locking pin with the locking pin fully inserted into the spring housing.
Figure 4:
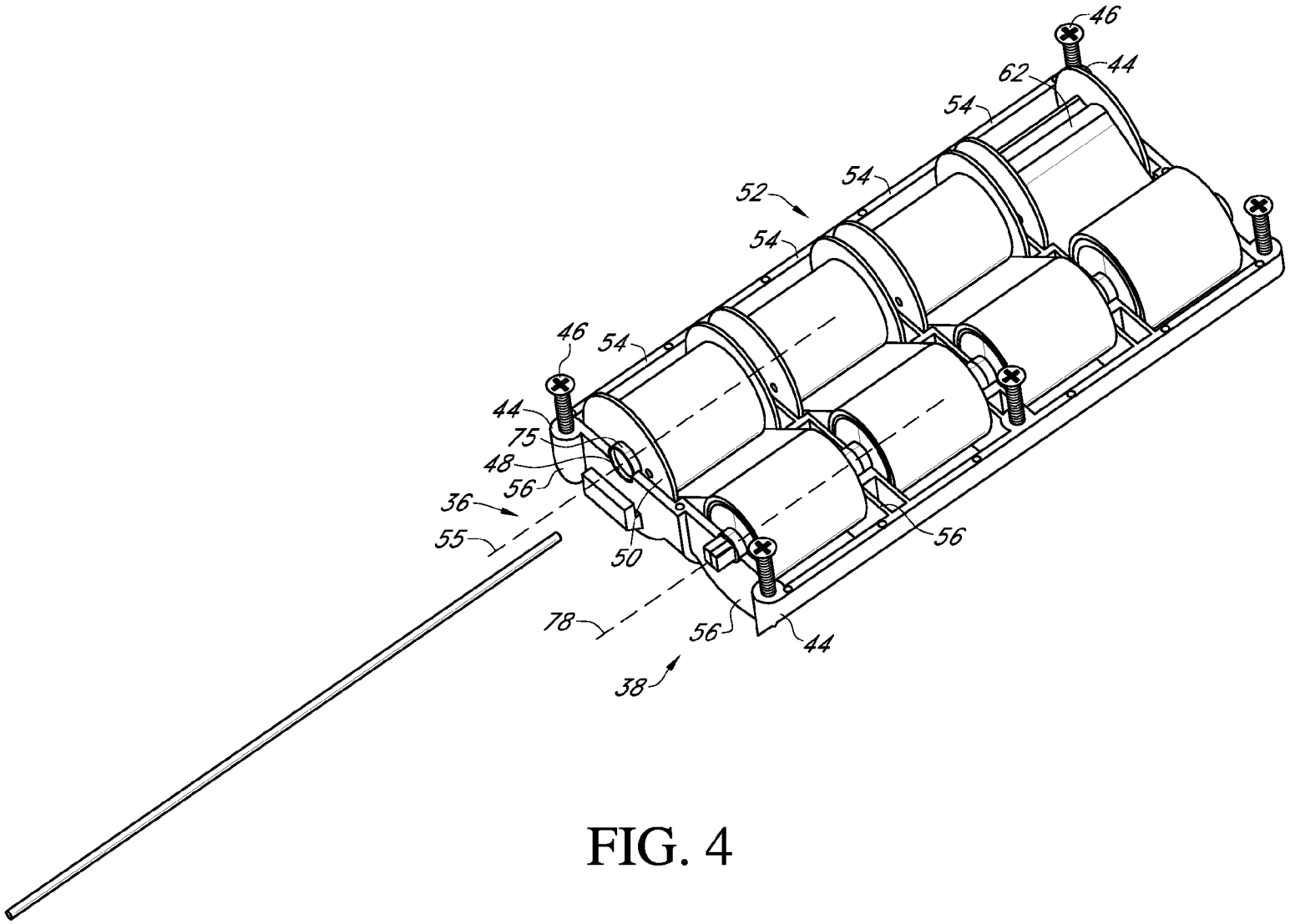
FIG. 4 is a perspective cut-away view of a spring housing a locking pin before the locking pin is inserted into the spring housing.
Figure 5:
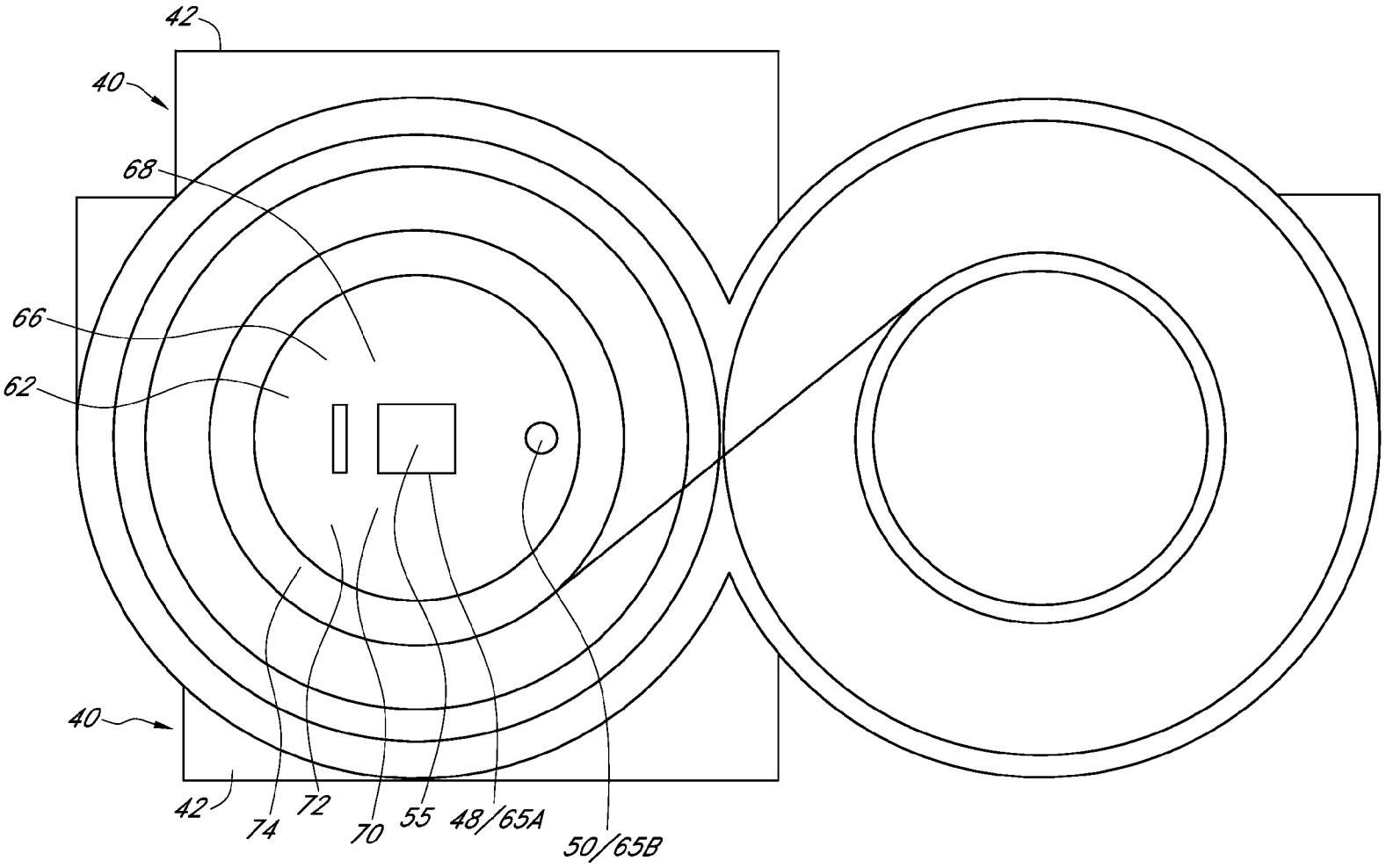
FIG. 5 is a side elevation cut-away view of a spring housing showing the slot opening and the locking feature of an output spool.
Figure 6:
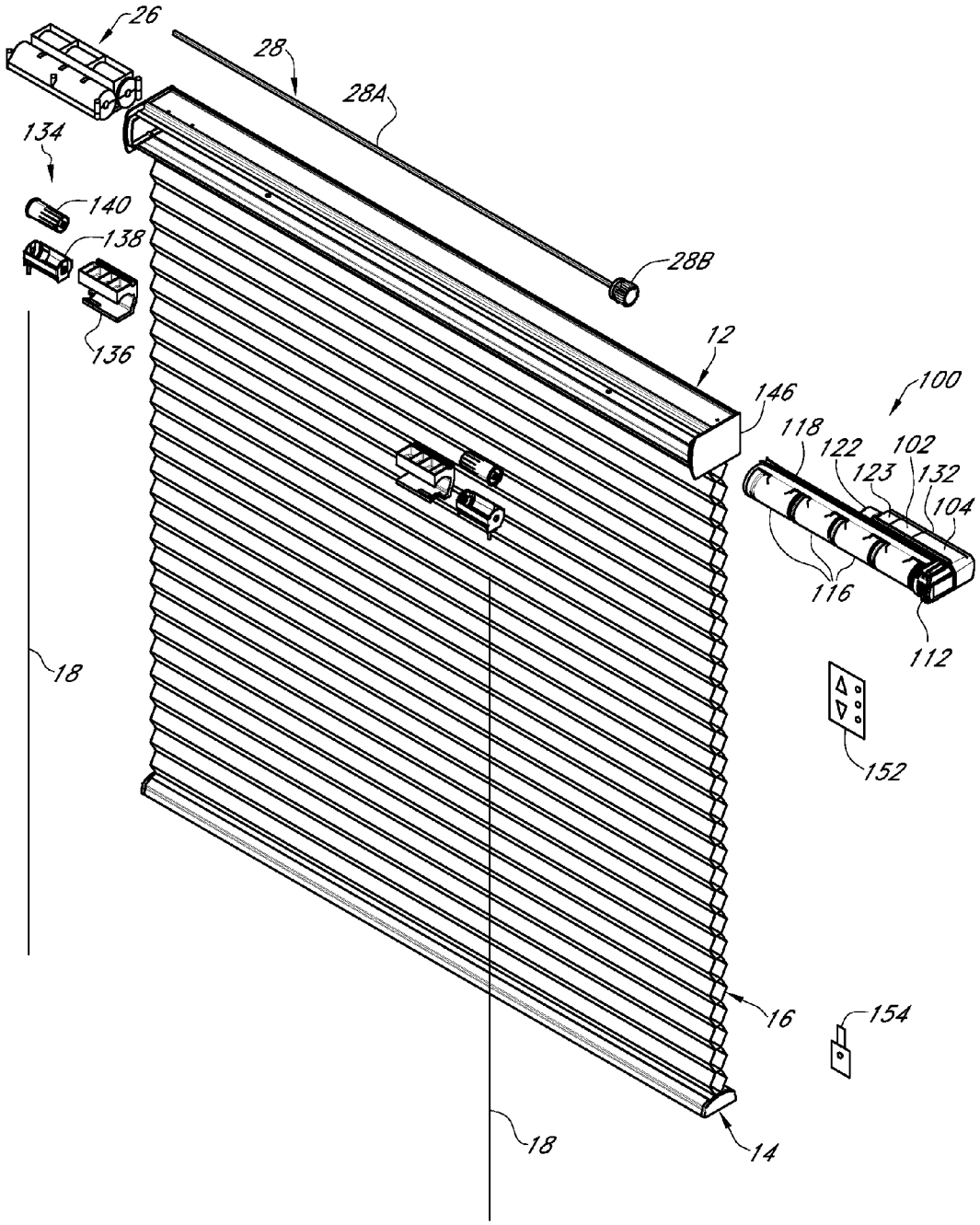
FIG. 6 is a perspective exploded view of an architectural covering showing the header, bottom bar, suspension cords, spring housing, drive shaft assembly, motor assembly and spool assemblies.
Figure 7:
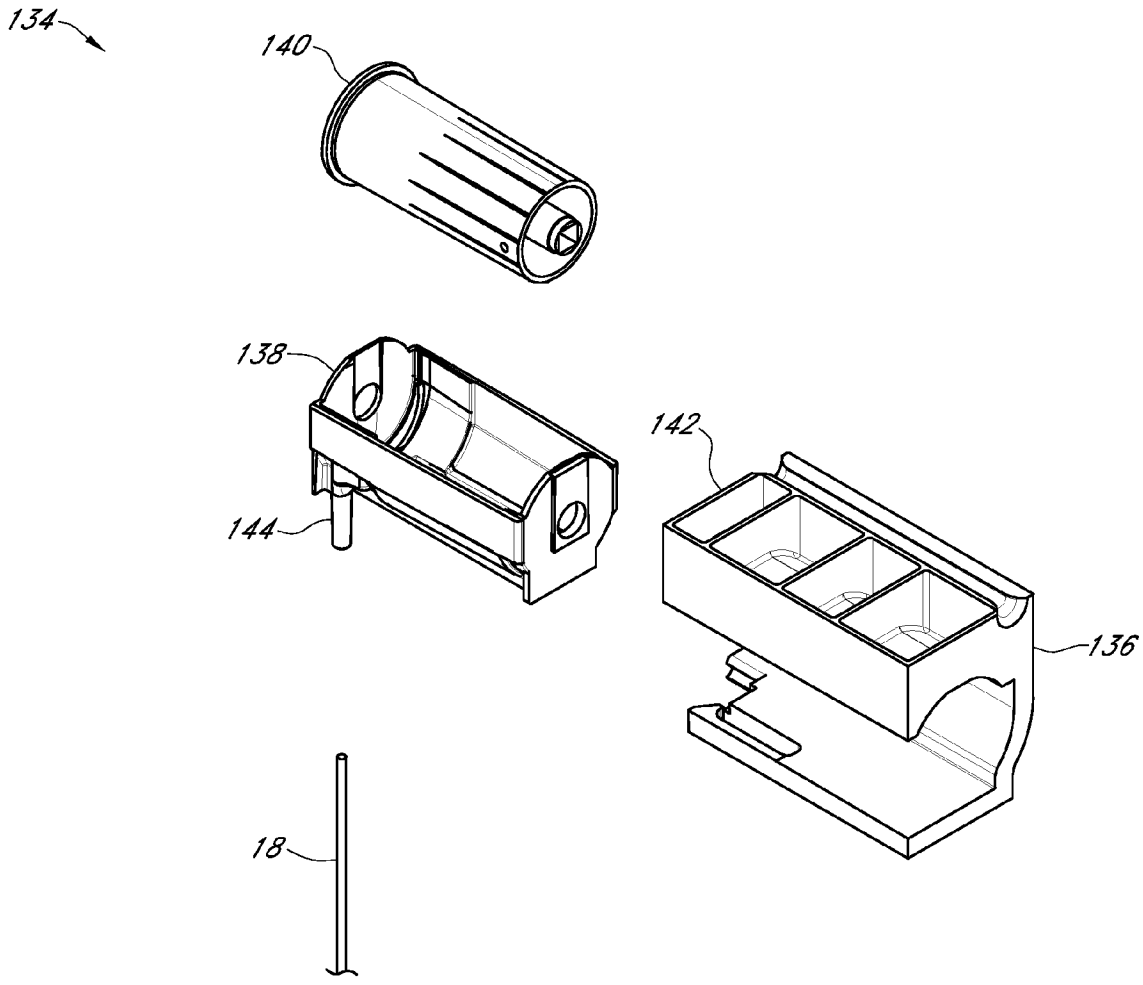
FIG. 7 is a perspective exploded view of spool assemblies.
Figure 8:
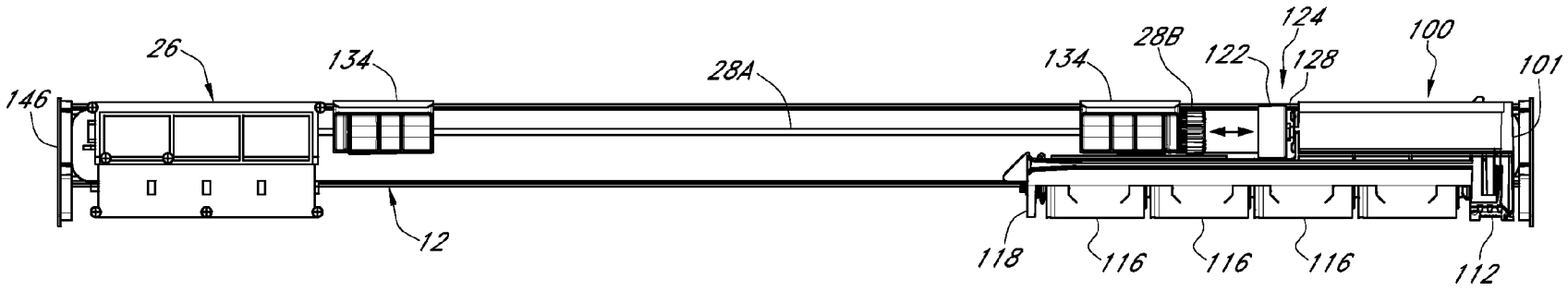
FIG. 8 is a top cut-away elevation view of an architectural covering showing the header having a spring housing, drive shaft assembly, motor assembly and spool assemblies positioned therein, with the motor assembly positioned slightly out of engagement with the drive shaft assembly for purposes of illustration.
Figure 9:
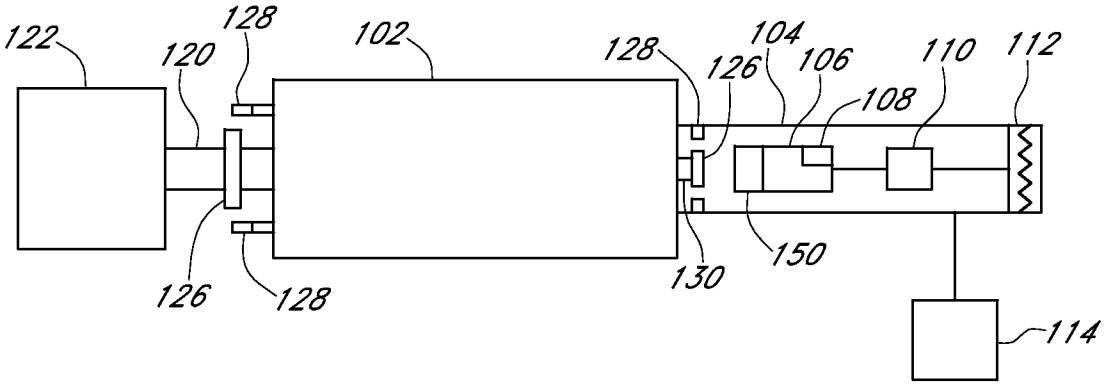
FIG. 9 is a schematic plan view of a motor assembly showing a motor, motor controller, sensor assembly, antenna, power source, motor shaft and motor gear among other features and elements.

In addition, different counterbalance weights can be accomplished by the manner in which the ribbon springs are mounted or wound. As one example, as can be easily seen in FIG. 3, the first three sets of output spools 60 and storage spools 80 are wound in what is called a standard mount, wherein the ribbon spring 72 passes over the top of the storage spool 80 and is back-bent under the output spool 60. In contrast, as is also seen in FIG. 3, the fourth set of output spool 60 and storage spool 80 are wound in what is called a reverse mount, wherein the ribbon spring 72 passes under the bottom of the storage spool 80 and is back-bent over the output spool 60. Varying the manner of mounting further allows variability of force generated by spring housing 26. To back-bend a ribbon spring 72 over a spool is to bend it or wrap in the direction opposite to its natural curvature, or stress. Further variation of the torque profile can be accomplished through pre-winding or pre-loading the ribbon springs 72 within spring housing 26 as more fully described in Applicant's related patent application Ser. No. 61/807,826, filed on Apr. 3, 2013, entitled System And Method For Pre-Winding And Locking Constant Torque Springs In A Spring Housing, which is fully incorporated by reference herein.

Spring housing 26 is designed to counterbalance a specific architectural covering 10 by first learning the dynamic weight of the bottom bar 14 and shade material 16 along the open/close cycle. This can be determined by testing of the specific architectural covering 10, or through a computer program analysis of known variables such as bottom bar weight, shade material weight, shade material elasticity, width, height and the like. Once the dynamic forces or weight are known, the appropriate ribbon springs 72, the appropriate number of springs are selected, as well as the manner of mounting the springs (i.e. standard mount or reverse mount) are determined. This too can be accomplished through testing or through a computer program analysis.

Once the spring housing 26 is designed, the ribbon springs 72 selected, and the manner of mounting is determined, the spring housing 26 is assembled. The bottom half 32 of spring housing 26 is selected. The first ribbon spring 72 is wrapped around the axel 82 of storage spool 80. Next the tail portion 70 of first ribbon spring 72 is inserted into slot opening 66 of the first output spool 60. The punch opening 74 of tail portion 70 is engaged with the locking feature 68 positioned within the slot opening 66. Once the locking feature 68 engages the punch opening 74, the locking feature 68 prevents ribbon spring 72 from being separated from the output spool 60.

The storage spool 80 is inserted into the storage spool recess 76 with the neck portion 86 of storage spool 80 rotatably engaging the collar portion 58 of end walls 56. The orientation of the storage spool 80 is dictated by whether the ribbon spring is mounted in a standard mount position or a reverse mount position. Once storage spool 80 is inserted into storage spool recess 76, storage spool 80 and the ribbon spring 72 mounted thereon can freely rotate within storage spool recess with the only frictional engagement being between neck portion 86 of storage spool 80 and collar portion 58 of end walls 56 on each side of storage spool 80.

The output spool 60 is similarly inserted into the output spool recess 54 with the neck portion 75 of output spool 60 rotatably engaging the collar portion 58 of end walls 56. Once output spool 60 is inserted into output spool recess 54, output spool 60 and the ribbon spring 72 mounted thereon can freely rotate within storage spool recess with the only frictional engagement being between neck portion 75 of output spool 60 and collar portion 58 of end walls 56 on each side of output spool 60.

This process is repeated for each set of output spool recesses 54 and storage spool recesses 76 until all components of the spring housing 26 are inserted therein. The top half 30 of the spring housing 26 is positioned over the bottom half 32 of spring housing with seam line 34 of each component engaging one another and fasteners 46 are passed through the connection sockets 44 and tightened thereby forming a unitary device.

In one arrangement, the storage spools 80 and output spools 60 can be connected to one another, before or after pre-loading or pre-winding, such that all connected storage spools 80 and/or all connected output spools 60 rotate together in unison.

Note: in some arrangements, not all output spool recesses 54 and storage spool recess 76 may be needed, as in some applications, such as lighter applications, less ribbon springs 72 are required. In addition, in some applications, such as heavier applications, two or more spring housings may be required. This ability to leave a blank or open set of output spool recesses 54 and storage spool recess 76, and/or use two or more spring housing 26 in a particular architectural covering, provides additional flexibility to the spring housing 26 as the same spring housing can be used in more and diverse applications. In addition, the modularity of this system (the ability to connect a plurality of spring housings 26 in end-to-end relation) easily allows for quick and easy manufacture of practically any counterbalance. In addition, it is hereby contemplated that spring housing 26 may be formed of only a single set of output spools 60 and storage spools 80 thereby requiring connection of multiple spring housings 26 in end-to-end modular relation to form the desired torque profile Once the spring housing 26 is fully assembled, it is pre-wound or preloaded for its particular application.

Figure 2:
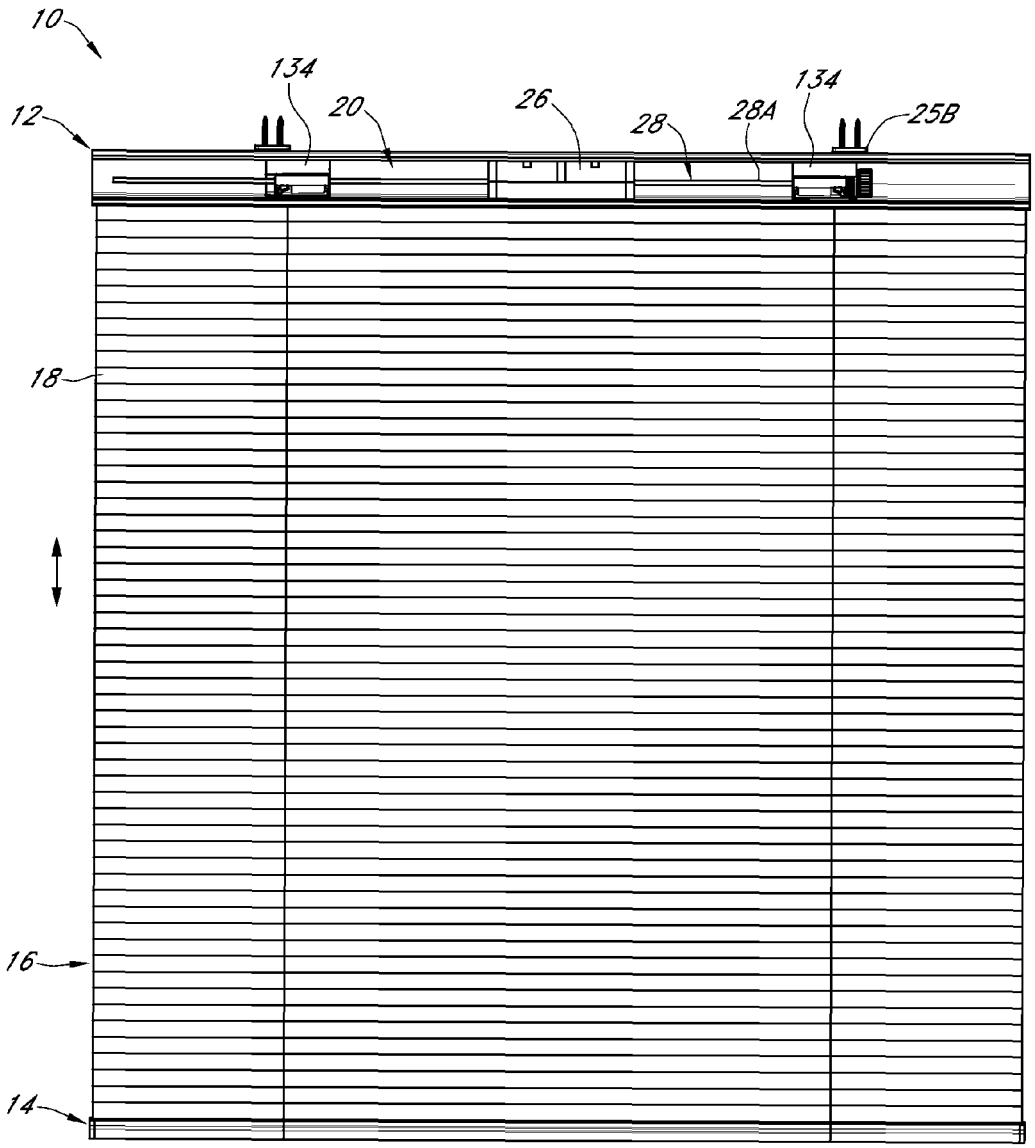
FIG. 2 is an elevation cut-away view of an architectural covering having a spring housing and a drive shaft assembly in its header.

Motor Assembly:

In one arrangement, as is shown in FIGS. 1 and 2, the architectural covering 10 can be used with only a spring housing 26 and a drive shaft assembly 28. In this arrangement, no motorization is used. Because the spring housing 26 provides a torque profile that closely matches the torque profile of the architectural covering 10, a user can easily open and close the architectural covering 10 by grasping the bottom bar 14, or any portion of the shade material 16 and moving it to the desired location, either by lifting up or pulling down. Alternatively, a cord (not shown) can be used to open or close the architectural covering 10, as is known in the art. Because the torque profile of the spring housing 26 closely matches the torque profile of the architectural covering 10, the weight or amount of force required to move the window covering from any position between fully open and fully closed to any position between fully open and fully closed is or should be approximately constant. That is, a user pushing or pulling the architectural covering from any position to any position should feel a constant drag, weight or resistance. This allows for easy and smooth operation of the architectural covering 10.

Further, because the torque profile of the spring housing 26 closely matches the torque profile of the architectural covering 10, the architectural covering 10 is easily motorized with the application of a motor assembly 100. Because the torque profile of the spring housing 26 closely matches the toque profile of the architectural covering 10 minimal torque and energy is required by motor assembly 100 to open and close the architectural covering 10. In addition, because of this close balance, the motor assembly 100 tends to open and close the architectural covering 10 smoothly and consistently and avoids loping or opening faster towards the bottom but slower towards the top. That is, because the spring housing 26 has a torque profile that closely matches the torque profile of the architectural covering 10 throughout the range of opening and closing, the motor assembly 100 does not have to lift more or less weight at the top or bottom of the cycle which can cause the architectural covering 10 to open fast when the bottom bar 14 is near the closed position, and open slowly when the bottom bar 14 is near the open position.

Motor assembly 100 has any size, shape and design. As one example, in the arrangement shown, motor assembly 100 includes a motor housing 101 with a motor 102 positioned therein. Motor 102 is any motor, such as a DC motor which converts electrical energy to mechanical energy. Motor 102 is connected to a motor controller 104. Motor controller 104 is any device which controls the operation of motor 102. In one arrangement, motor controller 104 is an electrical circuit board or PC board which is electrically connected to a microprocessor 106 connected to memory 108, a receiver or transceiver 110 and an antenna 112. Microprocessor 106 is any programmable device that accepts analog or digital signals or data as input, processes it according to instructions stored in its memory 108, and provides results as output. Microprocessor 106 receives signals from receiver or transceiver 110 and processes them according to its instructions stored in its memory 108 and then controls motor 102 based on these signals. Memory 108 is any form of electronic memory such as a hard drive, flash, ram or the like. Antenna 112 is any electronic device which converts electric power into electromagnetic signals or electromagnetic waves, which are commonly known as radio waves or RF (radio frequency) (hereinafter collectively referred to as "electromagnetic signals" without limitation). Antenna 112 can transmit and/or receive these electromagnetic signals. In one arrangement these electromagnetic signals are transmitted via AM or FM RF communication, while any other range of RF is hereby contemplated. In the arrangement shown, a meandering monopole antenna 112 is shown in the font of motor assembly 110 for purposes of strong and clear reception, however any other form of an antenna is hereby contemplated such as a fractal antenna, a telescoping antenna, or the like. Motor controller 104 is also connected to a power source 114 such as wall plug in, batteries, solar cell panels, or the like; in the arrangement shown a plurality of batteries 116 are connected to motor assembly 100 by a battery holder 118.

Motor assembly 100 also includes a motor shaft 120 connected to a motor gear 122. Motor gear 122 is formed of any size, shape and design. As one example, in the arrangement shown, motor gear 122 is a female gear which is sized and shaped to operably engage and receive drive gear 28B of drive shaft assembly 28.

Also connected to motor 102 is a gear box 123. In one arrangement, gear box is formed as an integral part of motor housing 101 and/or motor 102. In an alternative arrangement, gear box 123 is an add-on piece, not formed as part of motor housing 101 and/or motor 102. In the arrangement shown, gear box 123 is positioned between motor 102 and motor gear 122. Gear box 123 serves to affect or change the number of rotations of motor 102 to motor gear 122. That is, gear box 123 causes the motor gear 122 to rotate more or less times than motor 102 rotates, depending on its gear ratio. In one arrangement, motor 102 is rated as a 24V DC motor and gear box 123 is a planetary gear system with an 11:1, 22:1, 33:1, 40:1 ratio, or any other ration between 1:1 and 100:1, such as, for example, Buhler DC Gear Motor 1.61.077.423 manufactured by Bühler Motor GmbH, Anne-Frank-Str. 33-35, 90459 Nuremberg, Germany.

One feature of this arrangement is that the motor 102 is substantially underpowered in comparison to its rated voltage. That is, in one arrangement, motor 102 is rated as a 24V DC motor and is supplied with an average battery voltage of approximately half or less than half the motor's rated voltage. That is, when batteries 116 are standard D cell batteries having an average voltage of 1.2 to 1.5 volts, and an eight battery stack is used, then an average voltage supplied is between $9.6V_{avg}$ and $12V_{avg}$. Any other numbers of batteries are hereby contemplated for use such as:

1 D cell=1.2-1.5 $V_{avg}$ Percentage of voltage supplied to rated voltage=5%-6.25%

2 D cell=2.4-3 $V_{avg}$ Percentage of voltage supplied to rated voltage=10%-12.5%

3 D cell=3.6-4.5 $V_{avg}$ Percentage of voltage supplied to rated voltage=15%-18.75%

4 D cell=4.8-6 $V_{avg}$ Percentage of voltage supplied to rated voltage=20%-25%

5D cell=6-7.5 $V_{avg}$ Percentage of voltage supplied to rated voltage=25%-31.25%

6 D cell=7.2-9 $V_{avg}$ Percentage of voltage supplied to rated voltage=30%-37.5%

7 D cell=8.4-10.5 $V_{avg}$ Percentage of voltage supplied to rated voltage=35%-43.75%

8 D cell=9.6-12 $V_{avg}$ Percentage of voltage supplied to rated voltage=40%-50%

9 D cell=10.8-13.5 $V_{avg}$ Percentage of voltage supplied to rated voltage=45%-56.25%

10 D cell=12-15 $V_{avg}$ Percentage of voltage supplied to rated voltage=50%-62.5%

11 D cell=13.2-16.5% $V_{avg}$ Percentage of voltage supplied to rated voltage=55%-68.75%

12 D cell=14.4-18 $V_{avg}$ Percentage of voltage supplied to rated voltage=60%-75%

Any other number of batteries as well as any other type of batteries, such as C AA, AAA, 9-Volt, or the like, whether rechargeable or non-rechargeable, are hereby contemplated for use. The same can be said for the rated voltage of motor 102, 12 volt rated motors, as well as any motor rated at anywhere between 5 volts and 100 volts are hereby contemplated for use in the system.

As one example, when motor 102 is a 24V motor supplied with a battery voltage of $9.6V_{avg}$ motor 102 draws a current of about 0.1 A. However, under the same torsional loading and output speed (e.g., 30 rpm), a 12V DC gear motor with a similar gear system, such as, e.g., Baler DC Gear Motor 1.61.077.413, will draw a current of about 0.2 A when supplied with a battery voltage of $4.8V_{avg}$. Assuming similar motor efficiencies, the 24V DC gear motor supplied with $9.6V_{avg}$ advantageously draws about 50% less current than the 12V DC gear motor supplied with $4.8V_{avg}$ while producing the same power output. Drawing less current causes the batteries 116 to last longer, which is a phenomenon known as Peukert's law.

Peukert's law, expresses the capacity of a battery in terms of the rate at which it is discharged. As the rate increases, the battery's available capacity decreases. That is, battery manufacturers rate the capacity of a battery with reference to a discharge time. For example, a battery might be rated at 100 A·h when discharged at a rate that will fully discharge the battery in 20 hours. In this example, the discharge current would be 5 amperes. If the battery is discharged in a shorter time, with a higher current, the delivered capacity is less. Peukert's law describes an exponential relationship between the discharge current (normalized to some base rated current) and delivered capacity (normalized to the rated capacity) over some specified range of discharge currents.

Peukert's law may be expressed in various different ways, however one common equation that describes how long a battery will last under a particular load is as follows:

$$t=H(C/(I*H))^k$$

With the variables being as follows:

t—Time in hours. It's the time that the battery will last given a particular rate of discharge (the current).

H—The discharge time in hours that the Amp Hour specification is based on. For example, if you had a 100 Amp Hour battery at a 20 hour discharge rate, H would equal 20.

C—The battery capacity in Amp Hours based on the specified discharge time.

I—This is the current that we're solving for. For example, if we wanted to know how long a battery would last while drawing 7.5 amps, we would enter it here.

k the Peukert Exponent. Every battery has its own Peukert exponent (often between 1.95 and 1.6).

Generally speaking, the lower the load drawn from the battery, the longer the battery will last. Therefore, the benefit of longer battery life is received when the rated voltage of the motor 102 is much greater than the voltage produced by the batteries 116, by a factor of two or more or the like. In addition, by supplying this low amount of power to motor 102 this causes the motor 102 to operate at a reduced speed and reduced torque output. The reduced speed advantageously eliminates undesirable higher frequency noise associated with high speed operation making the device more desirable in applications where quiet operation is desirable. The reduced torque output requires or draws lower current from the batteries 116, thereby improving battery life. In other words, applying a lower-than-rated voltage to the motor 102 causes the motor 102 to run at a lower-than-rated speed, produce quieter operation, and longer battery life as compared to when motor 102 is running at its rated voltage, which draws similar amperage while producing lower run cycle times to produce equivalent mechanical power.

In the embodiment described above, when the 24 volt rated motor 102 is supplied with approximately 9.6 volts this enhances the cycle life of the battery by about 20% when compared to a 12V DC gear motor using the same battery capacity. Any form of battery, such as Alkaline, zinc and lead acid lithium or nickel batteries, are hereby contemplated for use and provide similar advantages.

In another example, four D-cell batteries produce an average battery voltage of about $4.8V_{avg}$ to while eight D-cell batteries produce an average battery voltage of about $9.6V_{avg}$. to $12V_{avg}$. Clearly, embodiments that include an eight D-cell battery stack advantageously provide twice as much battery capacity than those embodiments that include a four D-cell battery stack Of course, smaller battery sizes, such as, e.g., C-cell, AA-cell, etc., offer less capacity than D-cells.

In a further example, supplying a 12V DC gear motor with $9.6V_{avg}$. to $12V_{avg}$. increases the motor operating speed, which requires a higher gear ratio in order to provide same output speed as the 24V motor discussed above. In other words, assuming the same torsional loading, output speed (e.g., 30 rpm) and average battery voltage ($9.6V_{avg}$. to $12V_{avg}$.), the motor operating speed of the 24V DC gear motor will be about 50% of the motor operating speed of the 12V DC gear motor. The higher gear ratio required for the 12V motor typically requires an additional planetary gear stage, which reduces motor efficiency, increases generated noise, reduces back drive performance and may require a more complex motor controller. Consequently, those embodiments that include a 24V motor supplied offer higher efficiencies and less generated noise than 12V motor arrangements.

By under powering the motor 102, this causes the motor 102 to rotate slower than if the motor 102 was supplied with power at its rated voltage. Because it is desirable to have the bottom bar 14 open and close slowly, or at a comfortable speed for the average user, the motor 102 must be geared down. When the motor 10 is already rotating slowly, less gear reduction is required. The reduced amount of gear reduction needed provides the benefit of producing less gear noise. The reduced amount of gear reduction needed also provides the added benefit that the bottom bar 14 may be manually moved without breaking the gears in gear box 123. As an example, when the user wants to manually lower the bottom bar 14 the user may merely pull the bottom bar 14 downward. This causes the gear box 123 to rotate which causes motor 102 to rotate (also known as back drive). Because of the low gear ratio of the gear box 123 (such as 11:1 or 22:1 or the like) motor 102 does not have to rotate at the speeds required if gear box 123 was set up to handle the speed of motor 102 when full power is supplied to motor 102. This allows the motor 102 to be easily manually moved without breaking or shearing the gears in gear box 123. This arrangement also provides limited or minimal resistance to manually moving the motor 102. As such, by under powering the motor 102, manual as well as motorized movement is accomplished, among the benefits of lower noise amount, lower noise pitch, less back drive resistance and improved battery life, to name a few.

To detect rotation of drive shaft assembly 28 and motor 102, a sensor assembly 124 is connected to motor assembly 100. Sensor assembly 124 is any form of a device which senses the rotation or position of architectural covering 10. In one arrangement, as is shown, sensor assembly 124 includes a magnet 126 connected to motor shaft 120 such that when motor shaft 120 rotates, so rotates magnet 126. Positioned adjacent to magnet 126 is at least one, and as is shown two, Hall Effect sensors 128 positioned opposite one another. In an alternative arrangement, as is also shown magnet 126 is connected to a secondary shaft 130, extending out of motor 102 adjacent a side opposite motor shat 120. In this arrangement, Hall Effect sensors 128 are connected to PC board adjacent a wheel magnet 126. In this arrangement, as motor shaft 120 rotates, so rotates the magnet 126. The charging magnetic fields caused by rotation of the magnet 126 are sensed by sensors 128, thereby detecting movement of the shade. Sensors 128 then count and track movement of the shade. This arrangement is more fully described in Applicant's related patent application U.S. Ser. No. 13/847,607 filed on Mar. 20, 2013, entitled High Efficiency Roller Shade, which is a Continuation of U.S. patent application Ser. No. 13/276,963, filed on Oct. 19, 2011, which is a Continuation-in-Part of U.S. patent application Ser. No. 12/711,192, filed on Feb. 23, 2010 (now U.S. Pat. No. 8,299,734, issued on Oct. 30, 2012), the disclosures of which are incorporated herein by reference in their entireties, including any and all other related patent applications.

In one arrangement, when viewed from its end or side, motor assembly 100 has an exterior profile similar to spring housing 26. That is, the exterior surface of motor assembly also has support members 132 which extend outwardly therefrom and terminate in a generally flat and straight support surface 42, which is designed to flushly and matingly engage the floor 24 or ceiling 22 of open interior 20 of header 12. This prevents rattling therebetween during operation and prevents rotation of the motor assembly 100 when motor 102 is actuated.

Spool Assemblies:

Spool assemblies 134 are connected to suspension cords 18. Spool assemblies 134 are formed of any suitable size, shape and design. As one example, as is shown, spool assemblies 134 include a spool shroud 136 which hold a spool holder 138, which rotatably hold a spool 140 therein.

When viewed from its end or side, spool shroud 136 has an exterior profile similar to spring housing 26 and/or motor assembly 100, that is, the exterior surface of spool shroud 136 also has support members 142 which extend outwardly therefrom and terminate in a generally flat and straight support surface 42, which is designed to flushly and matingly engage the floor 24 or ceiling 22 of open interior 20 of header 12. This prevents rattling or movement therebetween during operation and prevents rotation of the spool assembly 134 during operation.

Spool assemblies 134 are assembled by inserting suspension cord 18 through guide 144 in spool holder 138. Next suspension cord 18 is connected to spool 140. Spool 140 is then inserted within spool holder 138 wherein when in position therein spool 140 is free to rotate. When spool 140 rotates within spool holder 138 in one direction suspension cord 18 is wrapped around spool 140, whereas in the opposite direction suspension cord 18 is removed from spool 140. Spool holder 138 is then positioned within spool shroud 136. Spool 140 has a spool through hole 144 which is sized and shaped to matingly receive drive shaft 28A of drive shaft assembly 28.

Overall System Assembly:

The overall system is assembled by connecting shade material 16 to header 12 and bottom bar 14. Suspension cords 18 are extended through the bottom bar 14, shade material 16 and into the open interior compartment 20 of header 12. Suspension cord 18 is inserted through guide 144 in spool holder 138 and is connected to spool 140. Spool 140 is then inserted within spool holder 138 and spool shroud 136 is slid into the open interior compartment 20 of header 12. In this arrangement, the flat upper and lower surfaces of spool assemblies 134 are in flat and flush frictional engagement with the flat ceiling 22 and floor 24 surfaces of open interior compartment 20 of header 12. Assembled and pre-wound spring housing 26 is also inserted or slid within the open interior compartment 20 of header 12. In this position, the support surfaces 42 of support members 40 of spring assembly 26 are in flat and flush frictional engagement with the flat ceiling 22 and floor 24 surfaces of open interior compartment 20 of header 12.

When spring housing 26 and spool assemblies 134 are positioned within the open interior compartment 20 of header 12, the spool through holes 144, the drive hole 48 of spring housing 26 and the drive hole of output spool 65A are in alignment with one another. In this position, drive shaft 28A of drive shaft assembly 28 is inserted through the spool assemblies 134 and spring housing 26.

Next, the motor assembly 100 is similarly inserted into the open interior compartment 20 of header 12. In this position, the support members 132 of motor assembly 100 are in flat and flush frictional engagement with the flat ceiling 22 and floor 24 surfaces of open interior compartment 20 of header 12. This prevents rattling movement and rotation of motor assembly 100 within header 12 when in operation. As motor assembly 100 is slid within the open interior compartment 20 of header 12, the motor gear 122 fully accepts or receives drive gear 28B therein. Next, end plates 146 and a cover plate 148 (not shown) are connected to header 12 and the system is fully assembled.

Because motor assembly 100 is wholly self-contained and includes its own self-contained on-board power source (batteries 116) the motor assembly 100 can be easily added and/or removed from the system by simply sliding the motor assembly 100 into and out of header 12 until motor gear 122 engages drive gear 28B. This simple modular arrangement and simple connection allows for easy conversion of a manual shade to a motorized shade and vice-versa. Also, because the spring housing 26 provides a counterbalance torque profile that closely matches the torque profile of the architectural covering 10, the manual opening and closing of the architectural covering 10 is essentially unaffected when the motor assembly 100 is added or removed, as manual operation will remain the same.

In Operation:

Once fully assembled, the spring housing 26, spool assemblies 134, motor assembly 100 are all connected to one another by drive shaft assembly 28. Therefore, as drive shaft assembly 28 rotates so rotates spring housing 26, spool assemblies 134 and motor assembly 100.

Because motor assembly 100 is wholly self-contained and includes its own self-contained on-board power source (batteries 116) the motor assembly 100 can be easily added and/or removed from the system by simply sliding the motor assembly 100 into and out of header 12 until motor gear 122 engages drive gear 28B. This simple modular arrangement and simple connection allows for easy conversion of a manual shade to a motorized shade and vice-versa. Also, because the spring housing 26 provides a counterbalance torque profile that closely matches the torque profile of the architectural covering 10, the manual opening and closing of the architectural covering 10 is essentially unaffected when the motor assembly 100 is added or removed, as manual operation will remain the same.

Manual Actuation:

When a user wants to manually move architectural covering from an open position to a closed position, as one example, the user reaches up, grasps bottom bar 14 and pulls downward. As the user pulls, a force is applied to the suspension cords 18. As the user overcomes the counterbalance torque of the spring housing 26 the suspension cords 18 rotate spools 140 within spool holders 138 within spool shrouds 136. As drive shaft 28A is matingly received through spool through hole 144 a rotation force is applied to drive shaft 28A. Drive shaft 28A is also matingly received by spring housing 26, or drive hole 48, 65A. As drive shaft 28A is rotated, the ribbon springs 72 begin to transfer from storage spools 80 to output spools 60, or vice versa. As the ribbon springs 72 move more from spool to spool (80, 60) the springs 72 exert the spring force stored within the spring steel of the springs 72 to drive shaft 28A as a counter balance. As motor assembly 100 is coupled to drive shaft 28A through drive gear 28B being coupled to motor gear 122, manual movement of the bottom bar 14 causes rotation (or back drive) of drive shaft 28A and forces motor 102 to similarly and simultaneously rotate with spring housing 26 and spool assemblies 134.

As the spring housing 26 provides a counterbalance torque profile closely matched and proportional to the torque profile of the architectural covering 10, the user experiences smooth manual operation of the architectural covering 10. That is, the force required by the user is constant or almost constant at any and all positions between open and closed. When the user stops applying force, and stops overcoming the force of the counterbalance, the architectural window covering stays in that position.

The opposite method applies to closing the architectural covering 10 by lifting up on the architectural covering.

Motorized Actuation:

When a user wants to move architectural covering using motor 102, there are a plurality of ways in which the user can actuate the motor 102 as are described herein. As one example, once the motor 102 is actuated to close the architectural covering from an open position to a closed position, the motor 102 rotates. As the motor 102 overcomes the counterbalance of spring housing 26 the motor 102 rotates motor gear 122 which rotates drive gear 28B which is coupled thereto. As drive gear 28B rotates drive shaft 28A is rotated. As the drive shaft 28A is rotated the spools 140 are rotated which pay out the suspension cords 18 which are pulled down by the force of gravity on the shade material 16 and bottom bar 14. Additionally, weight can be added to the bottom bar 14 to improve the gravitational effect on bottom bar 14. Simultaneously, as drive shaft 28A is also matingly received by spring housing 26, or drive hole 48, 65A as drive shaft 28A is rotated, the ribbon springs 72 begin to transfer from storage spools 80 to output spools 60, or vice versa, and apply the force generated by these ribbon springs 72 to drive shaft 28A as a counter balance.

As the spring housing 26 provides a counterbalance torque profile closely matched and proportional to the torque profile of the architectural covering 10, the motor 102 experiences smooth mechanical operation of the architectural covering 10. That is, the force required by the motor 102 is constant or almost constant at any and all positions between open and closed. This causes low constant and smooth power draw from batteries 116 and due to the low rotational speed and low gear ratio of gear box 123, low noise pitch and volume are generated. When the motor 102 stops applying force, and stops overcoming the force of the counterbalance, the architectural window covering 10 stays in that position. In one arrangement, when the motor 102 reaches its desired position, the motor controller 104 connects the positive and negative leads of motor 102 thereby creating a dynamic break which provides resistance to rotation thereby holding the position of bottom bar 14.

The opposite method applies to closing the architectural covering 10 by rotating the motor 102 in the opposite direction.

Activation of Motor Assembly:

Motorized control of architectural covering 10 can be implemented in several ways. As examples, the motor 102 can be actuated by tugging on the architectural covering, by using a remote control device using RF communication, by using a voice command and a voice command module, an internet enabled application, Wi-Fi communication, Bluetooth communication, cellular communication, or any other method.

Tugging:

One method of actuating the motor 102 is through tugging the architectural covering 10. This method and system is more fully described in Applicant's related patent application entitled Method Of Operating A Roller Shade; U.S. Pat. No. 8,368,328, with application Ser. No. 12/711,193 filed on Feb. 23, 2010, which is fully incorporated by reference herein including any related patent applications. While this Patent is directed to a roller shade operation, the teachings can be applied to honeycomb shades described herein. Tugging the architectural covering 10 is different than pulling or moving the architectural window covering. A tug is defined a small manual movement of the window covering, which is less than a predetermined distance, such as up to one, two, three, four or a couple inches. In contrast, a pull or moving the architectural covering is manual movement of the architectural covering 10 that is greater than the predetermined tug distance, such as several inches or more. In one arrangement, as an example, a tug is anything less than or equal to movement of 2 inches or less within a predetermined amount of time, such as a second. In one arrangement, there are three types of tugs 1. Micro Tug (Up to 1.5-2")—Sends shade up to next preset position;
2. Short Tug (Between 2-4")—Sends shade to upper limit;
3. Long Tug (More than 4")—Shade remains in the position it was pulled to.

When a user tugs or pulls the architectural covering 10, the suspension cords 18 are pulled, which rotate spools 140, which rotate drive shaft 28A which rotates motor 140. When motor 102 is forced to rotate it generates an electrical disturbance, such as generation of voltage and/or current. Motor controller 104 includes a switch 150, such as a MOSFET or transistor as examples. When switch detects the electrical disturbance generated by manual rotation of motor 140 switch toggles, closes, or otherwise sends power to other components of motor controller 104. This is called waking up the system from a sleep state. In sleep state, power use is minimized to maximize battery 116 life. When the motor controller 104 is woken up, Hall Effect sensors 128 are practically instantly energized. Once energized, Hall Effect sensors, which are positioned proximate to magnet 126 detect the changing magnetic fields due to the rotation of magnet 126. In this way, the Hall Effect Sensors 128 detect the number of rotations of motor 140. Hall Effect sensors 128 send these magnetic pulses to microprocessor 106 which deciphers these pulses pursuant to instructions stored in memory 108. Microprocessor 106 then determines whether this manual movement is a tug or a pull.

In one arrangement, the microprocessor 106 is programmed to recognize, one, two, three, or more tugs separated by a predetermined amount of time, such as between a quarter second and one and a half seconds. However any other amount of time between tugs is here by contemplated such as ¼ second, ½ second, ¾ second, 1 second, 1&¼ seconds, 1&½ seconds, 1&¾ seconds, 2 seconds, and the like. When microprocessor 106 detects a single tug, pursuant to instructions stored in memory 108 microprocessor 106 instructs motor 102 to go to a first corresponding position, such as open. When microprocessor 106 detects two tugs, pursuant to instructions stored in memory 108 microprocessor 106 instructs motor 102 to go to a second corresponding position, such as closed. When microprocessor 106 detects three tugs, pursuant to instructions stored in memory 108 microprocessor 106 instructs motor 102 to go to a third corresponding position, such as half open. Any number of tugs and positions can be programmed.

When a pull is detected, the microprocessor 106 recognizes the predetermined distance has been exceeded and therefore a tug is not present. When a pull is detected, the microprocessor 106 merely counts the number of rotations so as to know or remember the architectural covering's location for later use in actuation. When a pull is detected, microprocessor does not energize motor 102.

Remote Control and Voice Control Operation:

One method of actuating the motor 102 is through using a wireless remote 152. This method and system is more fully described in Applicant's related patent application entitled System And Method For Wireless Voice Actuation Of Motorized Window Coverings; Ser. No. 61/807,846 filed on Apr. 3, 2013, which is fully incorporated by reference herein. In that application, as is contemplated herein, a wireless remote 152 is actuated by the user, by pressing a button. When actuated, the wireless remote 152 transmits an electromagnetic signal over-the-air, which is received by the antenna 112 of the motor controller 104. Once antenna 112 receives the electromagnetic signal it is transmitted to transceiver 110 which converts the signal and transmits it to microprocessor 106. Microprocessor 106 interprets the signal based on instructions stored in memory 108 and actuates the architectural covering 10 to the predetermined position. As is also presented in that application, is a voice actuation module 154, which receives a user's voice command, converts it to an electromagnet signal which is received by architectural covering 10 in the manner described herein.

Internet Control and Operation:

One other method of actuating the motor 102 is through use of the internet and use of an electronic device. This method and system is more fully described in Applicant's related patent application entitled System And Method For Wireless Communication With And Control Of Motorized Window Coverings; Ser. No. 61/807,804 filed on Apr. 3, 2013, which is fully incorporated by reference herein. In that application, as is contemplated herein, motor 102 is actuated by a user having an internet enabled handheld device, such as a laptop, tablet or smartphone, which transmits a signal through the internet which is received at a gateway which then transmits an electromagnetic signal to the architectural coverings 10 as is described herein.

In another arrangement the architectural covering can be controlled using Bluetooth communication. In yet another arrangement the architectural covering can be controlled using controls wired directly to the unit.

From the above discussion it will be appreciated that system and method shown and described herein for manual and motorized manipulation of an architectural covering improves upon the state of the art.

Specifically, the system and method for manual and motorized manipulation of an architectural shown and described herein is easy to use, efficient, simple, accurate, inexpensive, has a minimum number of parts, and has an intuitive design. Thus, one of ordinary skill in the art would easily recognize that all of the stated objectives have been accomplished.

It will be appreciated by those skilled in the art that other various modifications could be made to the device without parting from the spirit and scope of this invention. All such modifications and changes fall within the scope of the claims and are intended to be covered thereby.

What is claimed:

1. An architectural covering comprising:

a header, a bottom bar, and shade material positioned between the header and bottom bar;

at least one suspension cord connected to the header, bottom bar, and shade material such that the weight of the bottom bar and the shade material are supported by the at least one suspension cord;

a spring housing connected to the header;

a drive shaft assembly connected to the header;

a motor assembly connected to the header;

the motor assembly having an electrically powered motor;

the shade material operatively connected to the motor assembly such that operation of the motor assembly changes the position of the shade material;

wherein the drive shaft assembly is connected to the spring housing and the motor assembly;

wherein the spring housing provides a counterbalance;

wherein the spring housing includes at least one standard wound spring;

wherein the spring housing includes at least one reverse wound spring;

wherein the shade material moves between an open position and a closed position;

wherein the shade material is movable to a different position by manual manipulation as well as by motorized manipulation.

2. The architectural covering of claim 1 wherein the drive shaft assembly connects directly to the spring housing and the motor assembly.

3. The architectural covering of claim 1 wherein the spring housing includes at least one negative gradient spring.

4. The architectural covering of claim 1 wherein the spring housing provides a counterbalance torque profile approximately equal to the shade system torque profile.

5. The architectural covering of claim 1 wherein the spring housing, drive shaft assembly, and motor assembly have an axis of rotation in alignment with one another.

6. The architectural covering of claim 1 wherein the motor assembly is actuated via a remote control device.

7. The architectural covering of claim 1 wherein the motor assembly is actuated via a voice actuation module.

8. The architectural covering of claim 1 wherein the motor assembly is actuated via a tug on the architectural covering.

9. The architectural covering of claim 1 wherein the motor assembly is electrically connected to a battery assembly.

10. The architectural covering of claim 1 wherein the at least one suspension cord is connected to the drive shaft assembly via a suspension cord spool assembly.

11. The architectural covering of claim 1 wherein the motor has a rated voltage and power is supplied to the motor at half or less than half of the rated voltage of the motor.

12. An architectural covering comprising:

a header, a bottom bar, and shade material positioned between the header and bottom bar;

at least one suspension cord connected to the header, bottom bar, and shade material such that the weight of the bottom bar and the shade material are supported by the at least one suspension cord;

a spring housing connected to the header;

a drive shaft assembly connected to the header;

a motor assembly connected to the header;

the motor assembly having an electrically powered motor;

the shade material operatively connected to the motor assembly such that operation of the motor assembly changes the position of the shade material;

wherein the drive shaft assembly is connected to the spring housing and the motor assembly;

wherein the spring housing provides a counterbalance;

wherein the spring housing includes at least one standard wound spring;

wherein the spring housing includes at least one reverse wound spring;

wherein the shade material moves between an open position and a fully closed position;

wherein the shade material is manually moved by pulling the shade material to a desired position and wherein motorized movement of the shade material is initiated by tugging on the architectural covering.

13. The architectural covering of claim 12 wherein the spring housing includes at least one negative gradient spring.

14. The architectural covering of claim 12 wherein the motor assembly is actuated via a remote control device.

15. The architectural covering of claim 12 wherein the motor assembly has a motor with a voltage rating, and therein power is supplied to the motor at half or less than half the voltage rating of the motor.

16. The architectural covering of claim 12 wherein tugging on the architectural covering is accomplished by tugging on the bottom bar.

17. The architectural covering of claim 12 wherein tugging on the architectural covering is accomplished by tugging on the shade material.

* * * * *